US010262588B2

(12) United States Patent
Yoon et al.

(10) Patent No.: US 10,262,588 B2
(45) Date of Patent: Apr. 16, 2019

(54) PIXEL, DISPLAY DEVICE INCLUDING THE SAME, AND DRIVING METHOD THEREOF

(71) Applicant: LG Display Co., Ltd., Seoul (KR)

(72) Inventors: SungWook Yoon, Gyeonggi-do (KR); Youngju Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/389,710

(22) Filed: Dec. 23, 2016

(65) Prior Publication Data

US 2017/0193899 A1 Jul. 6, 2017

(30) Foreign Application Priority Data

Dec. 30, 2015 (KR) ..... 10-2015-0190421

(51) Int. Cl.
*G09G 3/3233* (2016.01)

(52) U.S. Cl.
CPC ... *G09G 3/3233* (2013.01); *G09G 2300/0465* (2013.01); *G09G 2300/0842* (2013.01); *G09G 2310/08* (2013.01); *G09G 2320/0233* (2013.01); *G09G 2320/0295* (2013.01)

(58) Field of Classification Search
CPC .. G09G 3/3208; G09G 3/30; G09G 2320/045; G09G 3/3233
See application file for complete search history.

(56) References Cited

U.S. PATENT DOCUMENTS

2006/0208971 A1 9/2006 Deane
2010/0033469 A1 2/2010 Nathan et al.
2010/0073346 A1* 3/2010 Min ..... G09G 3/3291 345/211
2010/0156881 A1 6/2010 Kohno et al.
(Continued)

FOREIGN PATENT DOCUMENTS

CN 103839517 A 6/2014
CN 104658474 A 5/2015
(Continued)

OTHER PUBLICATIONS

Extended European Search Report dated Apr. 21, 2017, in corresponding European Application No. 16205051.2.
(Continued)

*Primary Examiner* — Yuzhen Shen
(74) *Attorney, Agent, or Firm* — Morgan, Lewis & Bockius LLP

(57) ABSTRACT

Provided are a pixel, a display device including the same, and a driving method thereof. A pixel includes: an organic light-emitting diode including an anode and a cathode, a first transistor configured to provide a driving current flowing through the organic light emission diode, a second transistor configured to provide data to a gate of the first transistor in response to a scan signal, a capacitor configured to maintain a difference between a voltage level of the data and a threshold voltage of the first transistor, and a third transistor configured to: sense a change of the threshold voltage of the first transistor in response to a sensing signal, and transfer a
(Continued)

reference voltage to a node coupled to the anode when the sensing signal is enabled, wherein a level of the reference voltage is lower than a threshold voltage of the organic light-emitting diode.

11 Claims, 7 Drawing Sheets

(56) References Cited

U.S. PATENT DOCUMENTS

| | | | | |
|---|---|---|---|---|
| 2011/0122119 | A1 | 5/2011 | Bae et al. | |
| 2011/0227505 | A1* | 9/2011 | Park | H05B 33/0896 315/297 |
| 2012/0075259 | A1 | 3/2012 | Chung | |
| 2012/0293478 | A1 | 11/2012 | Chaji et al. | |
| 2012/0299978 | A1 | 11/2012 | Chaji | |
| 2013/0050292 | A1* | 2/2013 | Mizukoshi | G09G 3/3291 345/690 |
| 2014/0139510 | A1* | 5/2014 | Han | G09G 3/3233 345/212 |
| 2014/0176401 | A1 | 6/2014 | Kim et al. | |
| 2014/0176516 | A1 | 6/2014 | Kim et al. | |
| 2015/0138179 | A1 | 5/2015 | Park | |
| 2015/0154908 | A1 | 6/2015 | Nam et al. | |
| 2015/0154913 | A1 | 6/2015 | Kim | |
| 2015/0187267 | A1 | 7/2015 | Park et al. | |
| 2015/0187275 | A1 | 7/2015 | Park et al. | |
| 2015/0187276 | A1 | 7/2015 | Shim et al. | |
| 2015/0294626 | A1* | 10/2015 | Bi | G09G 3/3233 345/211 |
| 2016/0300534 | A1 | 10/2016 | Kishi | |

FOREIGN PATENT DOCUMENTS

| | | | |
|---|---|---|---|
| CN | 104700772 | A | 6/2015 |
| JP | 2008-523448 | A | 7/2008 |
| JP | 2009-008799 | A | 1/2009 |
| JP | 2009-265459 | A | 11/2009 |
| JP | 2010-170079 | A | 8/2010 |
| JP | 2014-522503 | A | 9/2014 |
| JP | 2015-129926 | A | 7/2015 |
| JP | 2015-129934 | A | 7/2015 |
| KR | 10-2012-0032274 | A | 4/2012 |
| KR | 10-2015-0057191 | A | 5/2015 |
| KR | 10-2015-0078836 | A | 7/2015 |
| TW | 201137828 | A | 11/2011 |
| TW | 201426708 | A | 7/2014 |
| WO | 2015/093097 | A1 | 6/2015 |

OTHER PUBLICATIONS

European Office Action dated Oct. 12, 2017, issued in corresponding European Application No. 16205051.2.
Japanese Office Action dated Oct. 24, 2017, issued in corresponding Japanese Application No. 2016-243973.
Taiwanese Office Action dated Nov. 15, 2017, issued in corresponding Taiwanese Application No. 105141913.
Chinese Office Action dated Sep. 3, 2018, issued in corresponding Chinese Application No. 201611216417.7.

* cited by examiner

PIXEL, DISPLAY DEVICE INCLUDING THE SAME, AND DRIVING METHOD THEREOF

CROSS-REFERENCE TO RELATED APPLICATION(S)

This application claims the benefit of Korean Patent Application No. 10-2015-0190421, filed on Dec. 30, 2015, the entire disclosure of which is hereby incorporated by reference herein.

BACKGROUND

1. Technical Field

The present disclosure relates to a display device, and more particularly, to pixel in a a display device and a control method thereof.

2. Discussion of the Related Art

In a display device including an organic light-emitting diode (OLED), which is a self-emitting element, respective pixels can perform a grayscale presentation by controlling a driving current running through the OLED. The brightness deviation may occur in a display device due to the non-uniformity, which can be caused by process errors, and so forth, of electrical characteristics, such as the threshold voltage and mobility of the TFT, especially the driving TFT, in the respective pixels.

As a solution to the above-mentioned problem, the non-uniformity characteristic of the brightness due to the change of the electrical characteristics (e.g., the threshold voltage and mobility) of the driving TFT may be cured by sensing the change of the electrical characteristics of the driving TFT in the respective pixels, and by properly compensating for input data according to the sensing result. This solution is referred to as an "external compensation" scheme. A pixel, to which the external compensation scheme may be applied, may include a data TFT for receiving data, a light-emission control TFT for controlling the current amount of the OLED, and a sensing TFT for sensing, as well as the driving TFT.

FIG. 1 is a circuit diagram illustrating a basic structure of a pixel in which an external compensation scheme is adopted according to a related art. FIG. 2 is a timing diagram illustrating an operation of the pixel shown in FIG. 1.

With reference to FIGS. 1 and 2, the related art pixel includes a light-emission control thin film transistor (TFT) M1, a driving TFT M2, a data TFT M3, a sensing TFT M4, a capacitor Cs and an organic light-emitting diode OLED.

The light-emission control TFT M1 receives a light-emission control signal EM at its gate, receives a power voltage VDD at its drain, and is coupled to the driving TFT M2 at its source. The light-emission control TFT M1 stays turned on and allows current to flow through the driving TFT M2 when the light-emission control signal EM is enabled.

The driving TFT M2 is coupled to a first node "a" at its gate, is coupled to a second node "b" at its source, and is coupled to the light-emission control TFT M1 at its drain. When turned on, the driving TFT M2 controls a driving current to flow through the OLED. As the amount of the driving current becomes greater, the light emission amount of the OLED becomes greater, which makes the grayscale presentation possible. The driving current is related to the gate-to-source voltage $V_{GS}$ between the gate and source of the driving TFT M2. As the voltage $V_{GS}$ between the gate and source of the driving TFT M2 becomes greater, the amount of the driving current becomes greater. The data TFT M3 receives a scan signal "scan" at its gate, receives a data signal Data at its source, and is coupled to the first node "a" at its drain. The data TFT M3 transfers the data signal Data to the first node "a" when the scan signal "scan" is enabled.

The sensing TFT M4 receives a sensing signal "sense" at its gate, receives a reference voltage Ref at its source, and is coupled to a third node "c" at its drain. The third node "c" is electrically the same as the second node "b." The sensing TFT M4 senses the voltage change of the third node "c" when the sensing signal "sense" is enabled. For example, the sensing TFT M4 senses the threshold voltage of the driving TFT M2 by sensing the voltage of the third node "c".

The capacitor Cs is coupled between the first node "a" and the second node "b". The capacitor Cs maintains the voltage difference between the first node "a" and the second node "b" of the driving TFT M2 (i.e., the voltage difference between the gate and the source of the driving TFT M2). The OLED is coupled to the third node "c" at its anode, is coupled to a ground voltage VSS at its cathode, and includes an organic compound between the anode and the cathode.

In the above example, each of the light-emission control TFT M1, the driving TFT M2, the data TFT M3, and the sensing TFT M4 is an N-type metal oxide semiconductor (NMOS) TFT. However, any of the TFTs may be a P-type metal oxide semiconductor (PMOS) TFT, in which case, the respective source/drain terminals would be reversed from the above description.

During a first time period T1, the scan signal "scan" and the sensing signal "sense" are enabled while the light-emission control signal EM is disabled. During the first time period T1, the data TFT M3 turned on by the enabled scan signal "scan" transfers the data signal Data from a fourth node "d" to the first node "a". The capacitor Cs maintains the gate-to-source voltage $V_{GS}$ between the gate and source of the driving TFT M2.

The sensing TFT M4 is turned on by the sensing signal "sense" being enabled, and transfers the reference voltage Ref from a fifth node "e" to the third node "c". The light-emission control TFT M1 stays turned off due to the light-emission control signal EM being disabled, and blocks the driving current from flowing from the driving TFT M2 to the OLED. During the first time period T1, the data signal Data is provided for the grayscale presentation.

During a second time period T2, the scan signal "scan" and the sensing signal "sense" are disabled while the light-emission control signal EM is enabled. The light-emission control TFT M1 is turned on by the enabled the light-emission control signal EM, and the driving TFT M2 is also turned on by the voltage maintained in the capacitor Cs. Thus, the driving current flows through the OLED in proportion to the voltage maintained in the capacitor Cs. The second time period T2 is a light-emission period of the OLED, or a "display-on" period.

During a third time period T3, the scan signal "scan" and the light-emission control signal EM are disabled, while the sensing signal "sense" is enabled. Therefore, the data TFT M3 and the light-emission control TFT M1 are turned off, while the sensing TFT M4 is turned on. The sensing TFT M4 senses the voltage change of the third node "c" in response to the enabled sensing signal "sense" during the third time period T3 when the turned-off light-emission control TFT M1 blocks the driving current from flowing from the driving TFT M2 to the OLED. Although not illustrated, the sensed voltage is compared and a compensated voltage is obtained by a separate circuit, and thus the compensation operation may be completed.

According to the related art described above, the light-emission control signal EM and the light-emission control TFT M1, which control the time period for the light-emission of the OLED, are required to block the driving current from flowing through the OLED during the time period when the light emission is not required. Also, the sensing signal "sense" and the sensing TFT M4 controlled by the sensing signal "sense" are required for the external compensation scheme. A plurality of TFTs for respective functions in an area of a pixel limits a number of pixels in the size-limited display device.

It is a recent trend that the pixel size required for a high density display has been shrinking. A TFT for the compensation is required to cure the brightness deviation and to improve image quality. The highly dense and smaller pixel is also required to follow the recent trend. Accordingly, what is needed is a technology for compensating for a pixel without increasing the pixel size.

SUMMARY

Accordingly, the present disclosure is directed to a pixel, a display device including the same, and a driving method thereof that substantially obviate one or more of the problems due to limitations and disadvantages of the related art.

An object of the present disclosure is to provide a display device capable of compensating for electrical characteristics of pixels while reducing pixel size. Another object of the present disclosure is to provide a display device capable of compensating for electrical characteristics of pixels and suitable for implementing high density display with a smaller pixel size. Another object of the present disclosure is to provide a display device capable of curing brightness deviation and improving the image quality through a simple control scheme without drastic change of an existing pixel structure, and which is suitable for implementing a high density display.

Additional features and advantages will be set forth in the description that follows, and in part will be apparent from the description, or may be learned by practice of the invention. The objectives and other advantages of the disclosure will be realized and attained by the structure particularly pointed out in the written description and claims thereof as well as the appended drawings.

To achieve these and other advantages and in accordance with the purpose of the present disclosure, as embodied and broadly described, there is provided a pixel, including: an organic light-emitting diode including an anode and a cathode, a first transistor configured to provide a driving current flowing through the organic light emission diode, a second transistor configured to provide data to a gate of the first transistor in response to a scan signal, a capacitor configured to maintain a difference between a voltage level of the data and a threshold voltage of the first transistor, and a third transistor configured to: sense a change of the threshold voltage of the first transistor in response to a sensing signal, and transfer a reference voltage to a node coupled to the anode when the sensing signal is enabled, wherein a level of the reference voltage is lower than a threshold voltage of the organic light-emitting diode.

In another aspect, there is provided a control method of a display device including a sensing transistor configured to perform a sensing operation, an organic light-emitting diode and a driving transistor configured to control a current for light emission of the organic light-emitting diode, the method including: when controlling the organic light-emitting diode to be turned off while the sensing transistor is turned on, setting a reference voltage provided to the sensing transistor to have a lower level than a threshold voltage of the organic light-emitting diode, enabling a sensing signal to turn on the sensing transistor, and applying the reference voltage to an anode of the organic light-emitting diode in response to the sensing signal.

In another aspect, there is provided a display device, including: a panel including a plurality of pixels disposed at cross-points between data lines and scan lines, each of the pixels including an organic light-emitting diode, a scan driving unit configured to: provide a scan signal to the scan lines, and provide a sensing signal for external compensation to the panel, a data driving unit configured to provide a data to the data lines, and a power unit configured to provide the panel with: a high level voltage, a low level voltage, and a reference voltage, wherein the panel is further configured to control a time period of light emission of the organic light-emitting diode based on the sensing signal.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the invention and are incorporated in and constitute a part of this specification, illustrate implementations of the invention and together with the description serve to explain the principles of the disclosure.

Figure 1:
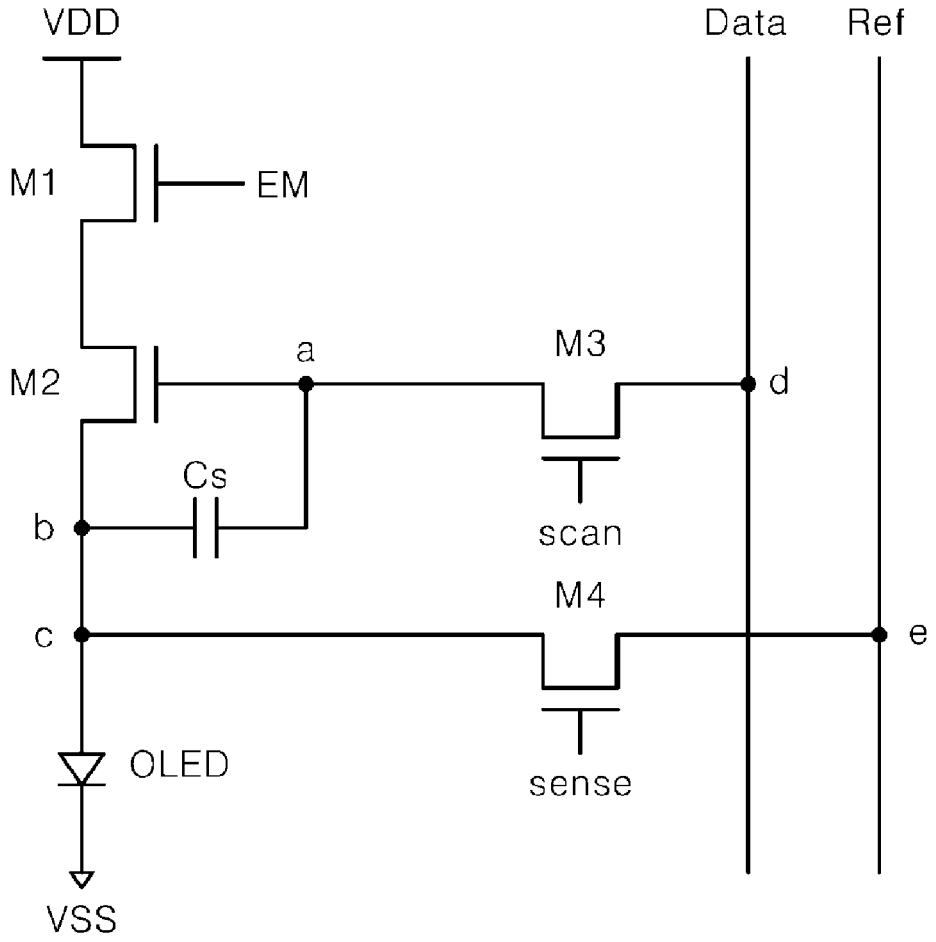
FIG. 1 (Related Art)
FIG. 1 is a circuit diagram illustrating a basic structure of a pixel in which an external compensation scheme is adopted according to a related art.
Figure 2:
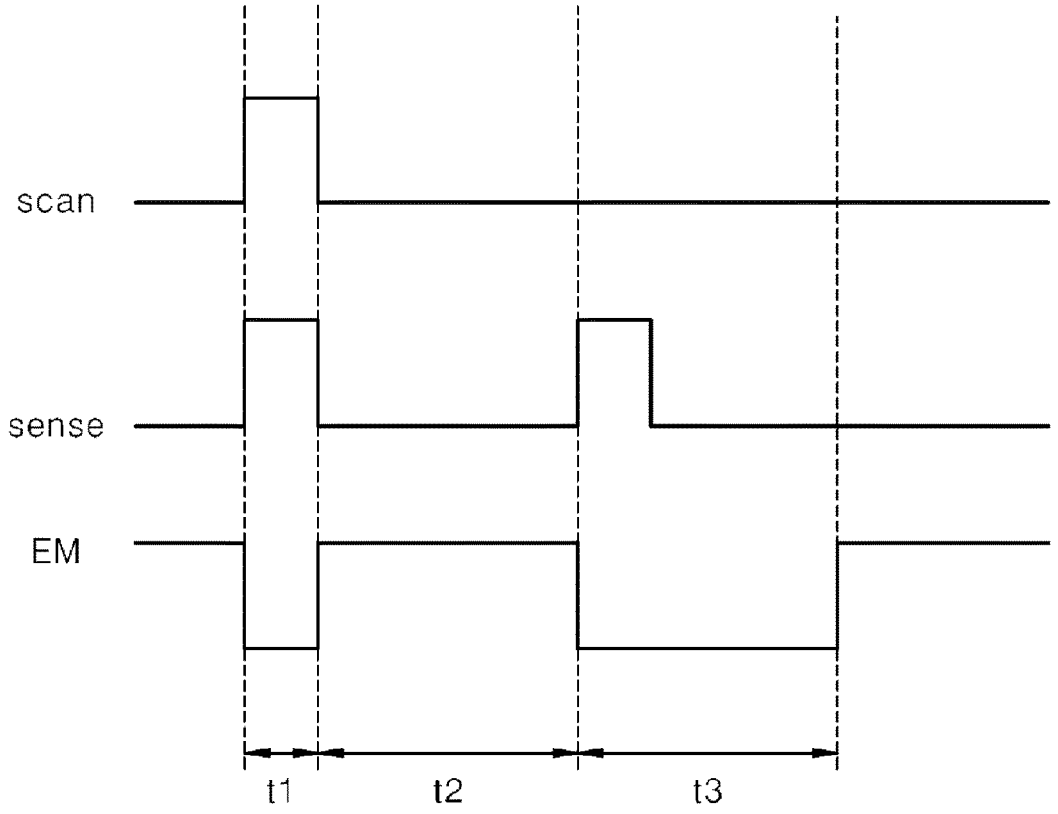
FIG. 2 (Related Art)
FIG. 2 is a timing diagram illustrating an operation of the pixel shown in FIG. 1.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which are illustrated in the accompanying drawings. In the following description, when a detailed description of well-known functions or configurations related to this document is determined to unnecessarily cloud a gist of the invention, the detailed description thereof will be omitted. The progression of processing steps and/or operations described is an example;

however, the sequence of steps and/or operations is not limited to that set forth herein and may be changed as is known in the art, with the exception of steps and/or operations necessarily occurring in a certain order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

In accordance with an embodiment of the present disclosure, a sensing TFT may be utilized to control the time period for the light-emission thereby improving the density of pixels in the size-limited display device, compensating for the pixel and improving the brightness of the pixel. Hereinafter, a display device and a method for controlling the same will be described in detail with reference to FIGS. 3 to 6.

Figure 3:
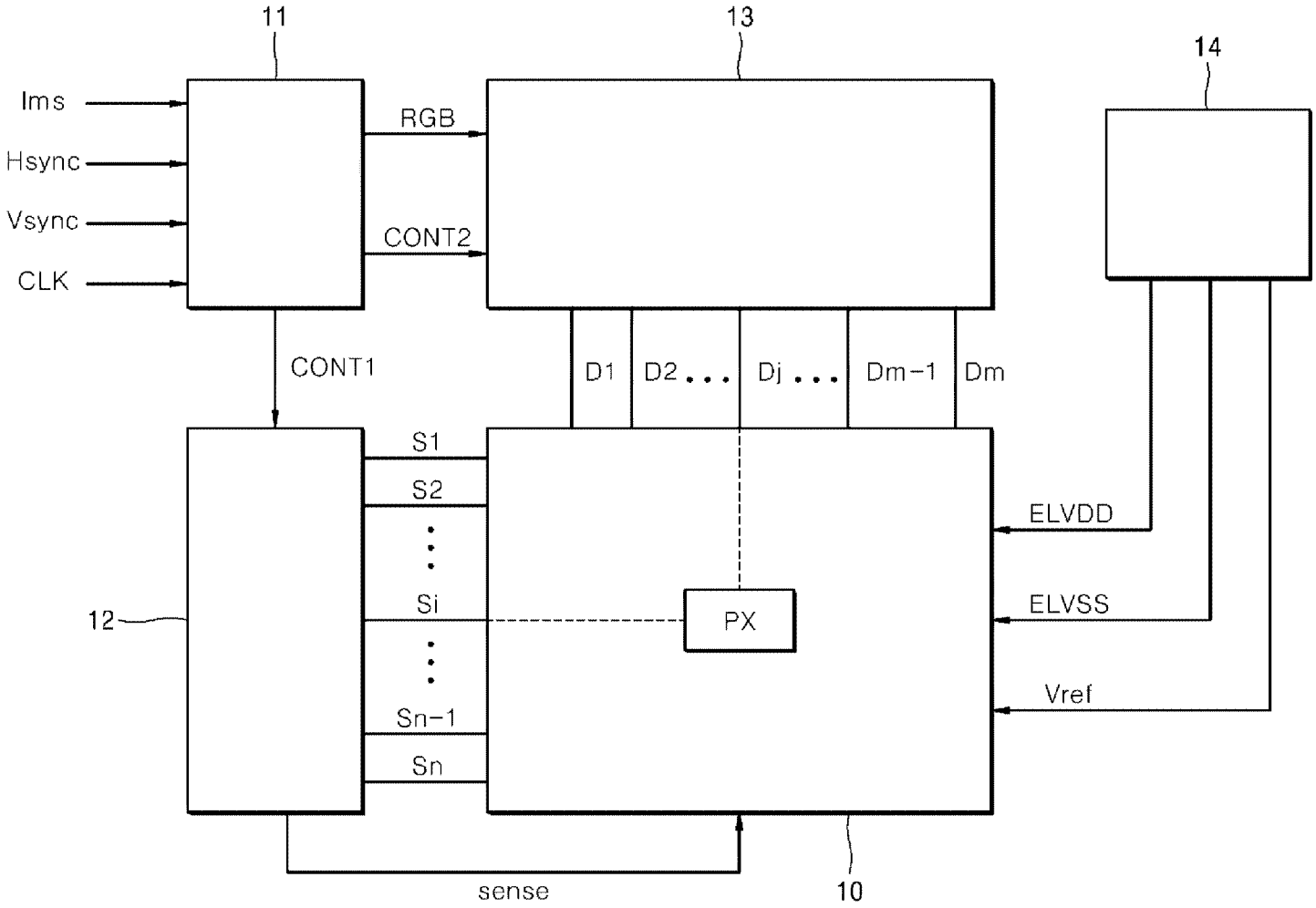
FIG. 3 is a block diagram illustrating a display device in accordance with an embodiment of the present disclosure.

FIG. 3 is a block diagram illustrating a display device in accordance with an embodiment of the present disclosure.

With reference to FIG. 3, a display device in accordance with an embodiment of the present disclosure may include a panel 10, a timing control unit 11, a scan driving unit 12, a data driving unit 13, and a power unit 14. The panel 10 may include a plurality of subpixels PX disposed in a matrix form and respectively located at cross-points formed by data lines D1 to Dm and scan lines S1 to Sn. A scan signal Si (i=1 to n) and a data Dj (j=1 to m) may control each of the plurality of subpixels PX to perform a light-emission operation. The scan driving unit 12 may provide the plurality of subpixels PX with the scan signal Si through the scan lines S1 to Sn. The data driving unit 13 may provide the plurality of subpixels PX with the data Dj through the data lines D1 to Dm. The scan driving unit 12 may provide the plurality of subpixels PX with a sensing signal "sense" as well as the scan signal Si.

Each of the plurality of subpixels PX may include an organic light-emitting diode (OLED), a plurality of thin film transistors (TFTs), and a capacitor for driving the OLED. In accordance with an embodiment of the present disclosure, a sensing TFT included in each of the plurality of subpixels PX may control the time period for the light-emission of the OLED besides the sensing operation for the external compensation scheme, which will be described with reference to FIGS. 4A and 4B.

The timing control unit 11 may receive a vertical synchronization signal Vsync, a horizontal synchronization signal Hsync, a clock signal CLK, and an image data signal Ims from an external source. The timing control unit 11 may control an operation timing of each of the scan driving unit 12 and the data driving unit 13 by respectively providing a scan control signal CONT1 to the scan driving unit 12 and a data control signal CONT2 to the data driving unit 13. Further, the timing control unit 11 may properly process the image data signal Ims provided from the external source according to an operation condition of the panel 10, and then may provide the data driving unit 13 with the processed image data signal Ims as a red/green/blue data signal RGB.

The scan driving unit 12 may apply a gate turn-on voltage to the scan lines S1 to Sn included in the panel 10 in response to the scan control signal CONT1 provided from the timing control unit 11. The scan driving unit 12 may control whether to turn on a cell transistor to apply a grayscale voltage, to be applied to each of the plurality of subpixels PX, to a pixel corresponding to the cell transistor through the applying of the gate turn-on voltage. Further, the scan driving unit 12 may provide the sensing signal "sense" for the external compensation scheme to the plurality of subpixels PX included in the panel 10.

The data driving unit 13 may receive the data control signal CONT2 and the RGB signal generated by the timing control unit 11, and may provide the data Dj to each of the plurality of subpixels PX included in the panel 10 through the data lines D1 to Dm. The power unit 14 may provide the panel 10 with a high level voltage ELVDD, a low level voltage ELVSS and a reference voltage Vref.

Hereinafter, a structure and an operation of the subpixel in accordance with an embodiment of the present disclosure will be described in detail. The operation of the subpixel will be described with reference to FIG. 4A to FIG. 5.

Figure 4A:
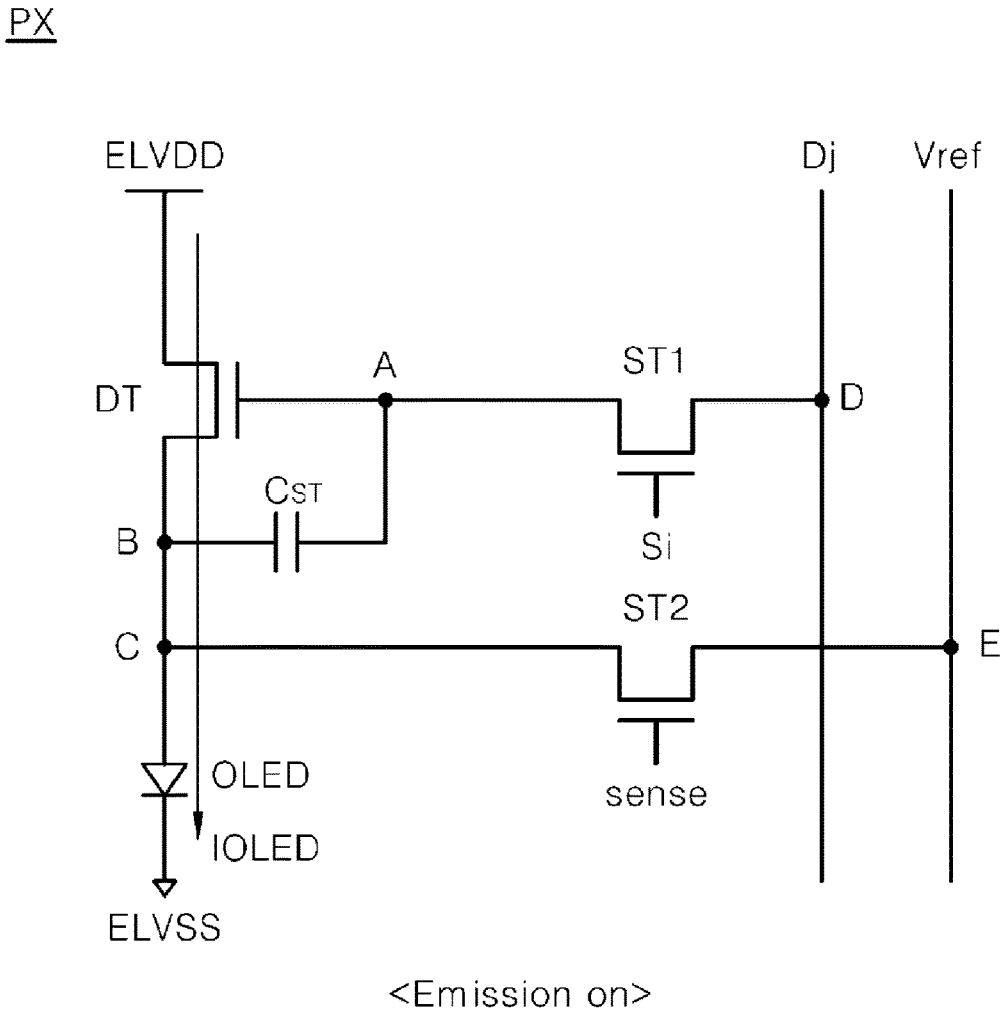
FIGS. 4A and 4B are equivalent circuit diagrams illustrating a subpixel shown in FIG. 3.
Figure 4B:
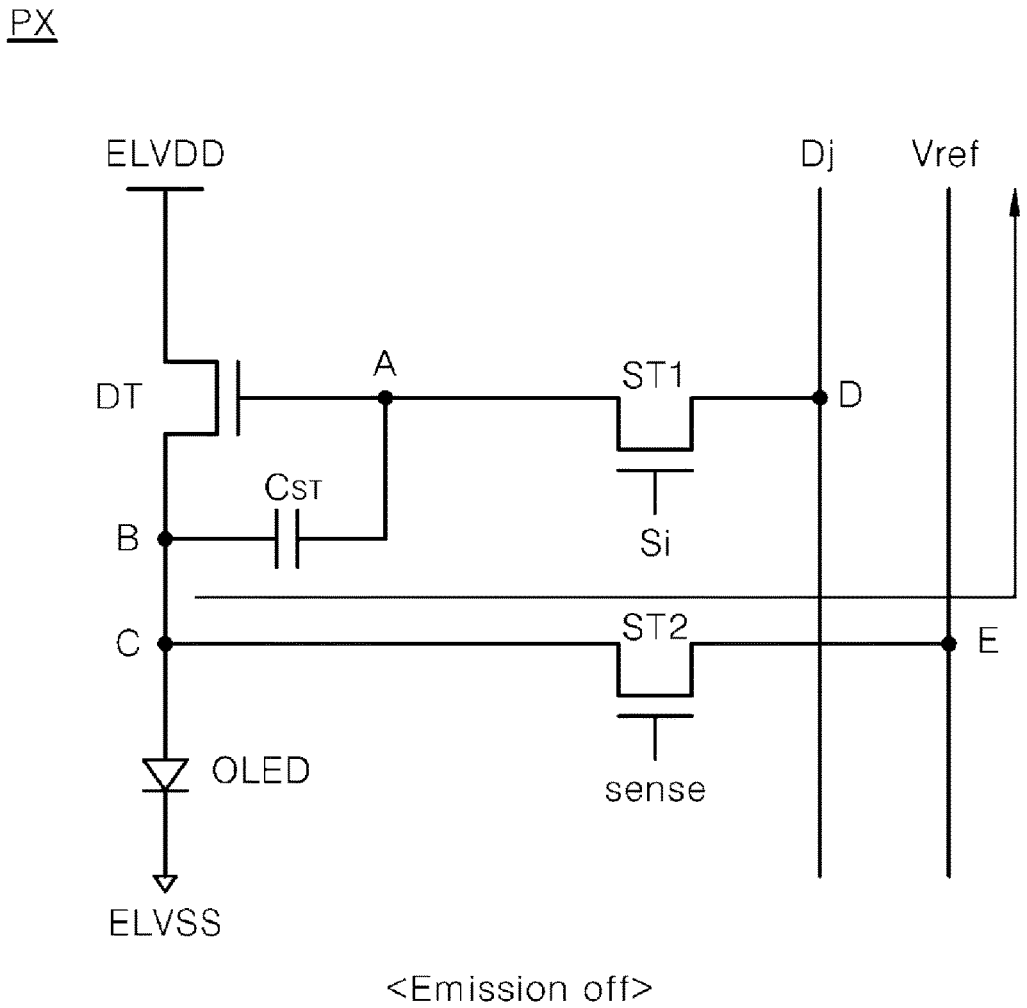
Figure 5:
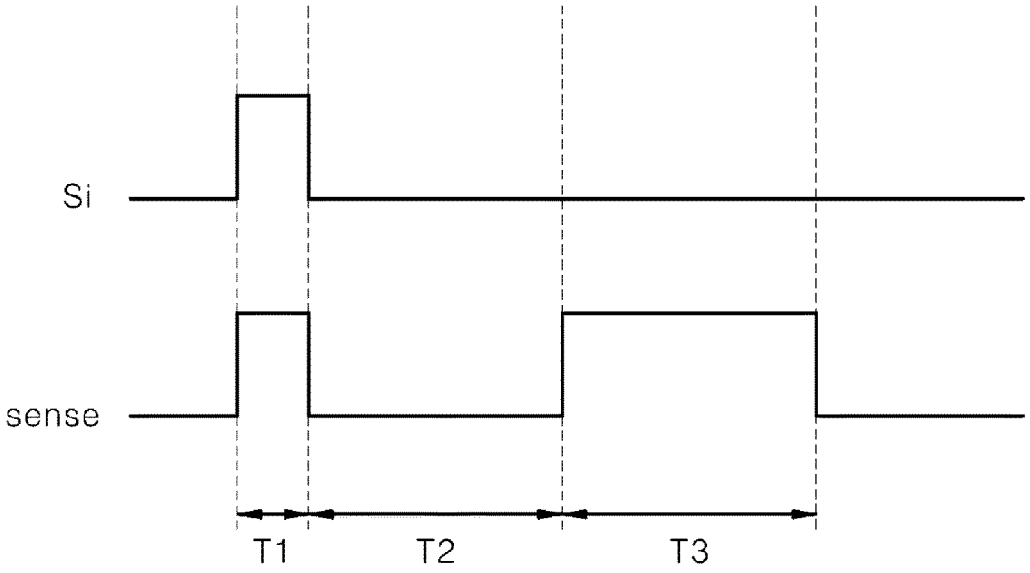
FIG. 5 is a timing diagram illustrating an operation of the subpixel shown in FIGS. 4A and 4B.

FIGS. 4A and 4B are equivalent circuit diagrams illustrating the subpixel shown in FIG. 3. FIG. 5 is a timing diagram illustrating an operation of the subpixel shown in FIGS. 4A and 4B.

With reference to FIGS. 4A and 4B, the subpixel PX (e.g., the subpixel PX of the example of FIG. 3) may include a driving TFT DT, a data TFT ST1, a sensing TFT ST2, a capacitor $C_{ST}$, and an organic light-emitting diode OLED.

The driving TFT DT may be coupled to a first node A at its gate, coupled to second node B at its source, and coupled to the high level voltage ELVDD at its drain. When turned on, the driving TFT DT may control a driving current IOLED to flow through the OLED. As the amount of the driving current IOLED becomes greater, the light-emission amount of the OLED becomes greater, which makes the grayscale presentation possible. As a gate-to-source voltage $V_{GS}$ between the gate and source of the driving TFT DT becomes greater, the amount of the driving current IOLED becomes greater.

The data TFT ST1 may receive, at its gate, a gate turn-on voltage signal or the scan signal Si provided through the scan lines S1 to Sn; may receive, at its source, the data Dj provided through the data lines D1 to Dm; and may be coupled to the first node A at its drain. The data TFT ST1 may provide the data Dj to the first node A when the scan signal Si is enabled.

The sensing TFT ST2 may receive the sensing signal "sense" at its gate, may receive, at its source, the reference voltage Vref provided through a fifth node E, and may be coupled to third node C at its drain. The sensing TFT ST2 may provide the reference voltage Vref to the third node C when the sensing signal "sense" is enabled.

In accordance with an embodiment of the present disclosure, the sensing TFT ST2 may control flow of the driving current IOLED through the OLED. Based on the enabling state of the sensing signal "sense", the sensing TFT ST2 may control the driving current IOLED to flow through the OLED (as illustrated in FIG. 4A, "Emission on") and not to flow through the OLED (as illustrated in FIG. 4B, "Emission off"). The amount of the driving current IOLED may be in proportion to the size of the data Dj. As described below, when turned-on, the sensing TFT ST2 may provide the reference voltage Vref of a predetermined voltage level to the third node C for the OLED not to emit light.

The capacitor $C_{ST}$ may be coupled between the first node A and the second node B. The capacitor $C_{ST}$ may maintain the voltage difference between the first node A and the second node B of the driving TFT DT.

The OLED may be coupled to the third node C at its anode, may be coupled to the low level voltage ELVSS at its cathode, and may include an organic compound between the anode and the cathode. The OLED may emit primary-colored light. For example, the primary colors may include red, green, and blue. In another example, the primary colors may include red, white, green, and blue. Embodiments are not limited to these examples.

In the examples described herein, each of the driving TFT DT, the data TFT ST1 and the sensing TFT ST2 may be an NMOS TFT, which is turned on by a signal of a logic high level. However, the present disclosure is not limited thereto, and any of the TFTs may be a PMOS TFT, which is turned on by a signal of a logic low level.

With reference to FIGS. 4A and 5, during a second time period T2 of light emission, the scan signal Si and the sensing signal "sense" may be of logic low level. Therefore, the data TFT ST1 and the sensing TFT ST2 may stay turned off. The driving TFT DT may be turned on based on the voltage, which is maintained by the capacitor $C_{ST}$ from having charged during a first time period T1 (to be explained later) previous to the second time period T2. Thus, the driving current IOLED may flow from the driving TFT DT through the OLED. The OLED may emit as much light as allowed by the amount of the driving current in proportion to the voltage $V_{GS}$ of the driving TFT DT.

A light emission off or display off period (e.g., time periods T1 and T3) will be described with reference to FIGS. 4B and 5.

During a first time period T1, the scan signal Si and the sensing signal "sense" may be of a logic high level. Therefore, the data TFT ST1 and the sensing TFT ST2 may be turned on. The data TFT ST1 may transfer data Dj of a fourth node D to the first node A in response to the enabled scan signal Si during the time period T1. The capacitor $C_{ST}$ may maintain the gate-to-source voltage $V_{GS}$ of the driving TFT DT. That is, the capacitor $C_{ST}$ may maintain the voltage on the gate of the driving TFT DT minus the threshold voltage of the driving TFT DT. The sensing TFT ST2 turned on by the enabled sensing signal "sense" may transfer the reference voltage Vref to the third node C.

The level of the reference voltage Vref may be in a voltage range in which the OLED does not emit light. For example, when the threshold voltage of the OLED is 0.7 V, the reference voltage Vref may be 0.6 V. Therefore, when the sensing signal "sense" is enabled, the reference voltage Vref, the level of which is lower than the threshold voltage of the OLED, may be applied to the anode of the OLED. Thus, the OLED may be turned off.

In accordance with an embodiment of the present disclosure, during the first time period T1, a current may flow from the driving TFT DT toward the reference voltage Vref through the third node C, the sensing TFT ST2, and the fifth node E. In other words, during the time period T1 when the capacitor $C_{ST}$ maintains the voltage according to the amount of the data Dj, the driving current IOLED may not flow through the OLED. Thus, the light emission of the OLED may be blocked. In accordance with an embodiment of the present disclosure, the time period when the light emission of the OLED is blocked may be controlled without a light-emission control signal or a light-emission control TFT.

During the third time period T3, the scan signal Si may be of a logic low level and the sensing signal "sense" may be of a logic high level. Therefore, the data TFT ST1 may be turned off and the sensing TFT ST2 may be turned on. During the third time period T3, when the reference voltage Vref having lower level than the threshold voltage of the OLED is provided, a current may flow from the driving TFT DT toward the reference voltage Vref through the third node C, the sensing TFT ST2, and the fifth node E. Therefore, the sensing operation may be stably performed in response to the enabled sensing signal "sense. The duration time of the sensing signal "sense" may be adjusted, for example, for accuracy of the sensing operation. Although not illustrated, the sensed voltage is compared and a compensated voltage is obtained by a separate circuit. Thus, the compensation operation may be completed. It should be appreciated that the logic levels may be changed based on the type of TFT used, e.g., NMOS or PMOS.

According to the related art, the sensing signal is a pulse-shaped signal, which is because the sensing signal is used as a switching signal for activating the sensing operation. However, in accordance with an embodiment of the present disclosure, the sensing signal "sense" may not be a pulse-shaped signal. This is because the activation of the time period of the light emission and the duration time of the light emission are controlled by adjusting the duration time the sensing signal "sense". Further, the reference voltage Vref transferred by the sensing TFT ST2 may have lower level than the threshold voltage of the OLED, and may have not fixed but variable voltage level when necessary.

Figure 6:
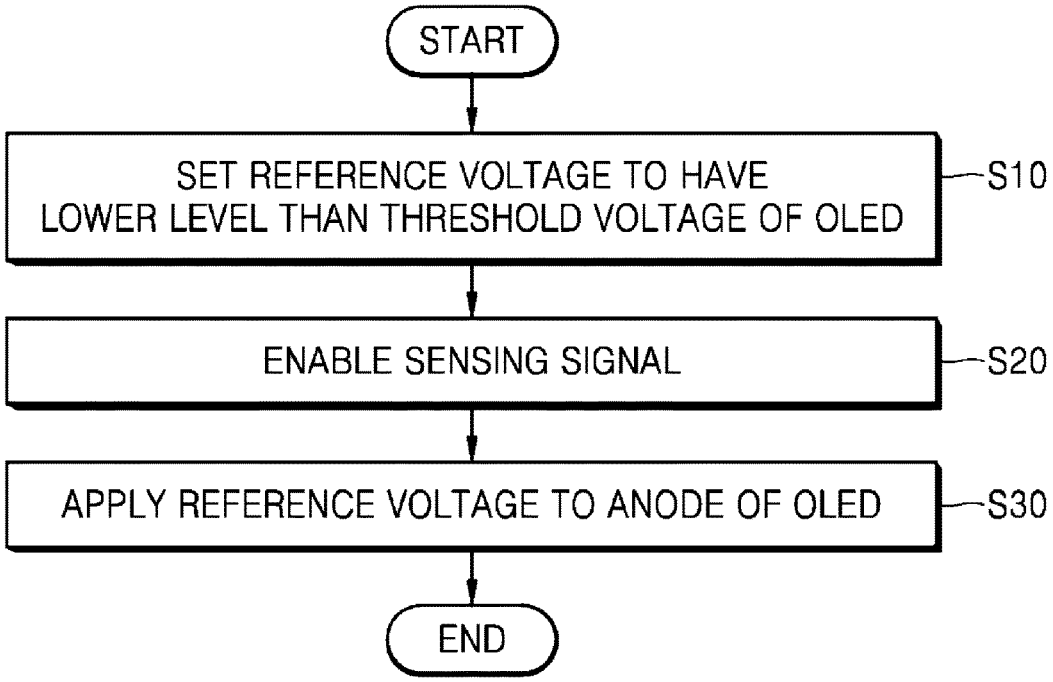
FIG. 6 is a flowchart illustrating an operation of the subpixel shown in FIG. 4B.

FIG. 6 is a flowchart illustrating an operation of the subpixel shown in FIG. 4B.

With reference to FIGS. 4B and 6, the reference voltage Vref may be set to have lower level than the threshold voltage level of the OLED at operation S10. Therefore, while the sensing signal "sense" is enabled, the light emission of the OLED may be blocked. That is, while the data Dj is provided or the sensing operation is performed, the light emission of the OLED may be blocked. Thus, unnecessary stress applied to the OLED may be reduced.

Next, the sensing signal "sense" may be enabled at operation S20. In an example in which the data Dj is provided, the scan signal Si may be enabled and the sensing signal "sense" may be provided in the form of a pulse. In an example in which the sensing operation is performed, the scan signal Si may be disabled and the sensing signal "sense" may be provided to have a predetermined duration time. The sensing signal "sense" may have a duration time long enough to satisfy a time required for the sensing operation.

Next, the reference voltage Vref may be provided to the anode of the OLED in response to the enabled sensing signal "sense" at operation S30. The reference voltage Vref, the level of which is lower than the threshold voltage of the OLED, may be applied to the anode of the OLED. Thus, the OLED may be turned off; the OLED may not emit light.

In accordance with an embodiment of the present disclosure, the time period of the light emission of the OLED may be controlled by the TFT for the external compensation scheme without having the TFT for controlling the time period of the light-emission of the OLED according to the related art. Accordingly, the same duty drive as the related art may be implemented with a smaller number of TFTs in the subpixel. Such duty drive may cure image degradation including the flicker.

In accordance with an embodiment of the present disclosure, a display device may compensate for electrical characteristics of pixels and may implement a high density display with a smaller pixel size. In accordance with an embodiment of the present disclosure, a display device may cure the brightness deviation of the related art, and may improve the image quality through a simple control scheme without drastic change of the existing pixel structure, and may implement a high density display.

It will be apparent to those skilled in the art that various modifications and variations may be made in the present disclosure without departing from the spirit or scope of the invention. Thus, it is intended that embodiments of the present disclosure cover the modifications and variations of this invention provided they come within the scope of the appended claims and their equivalents.

What is claimed is:

1. A pixel, comprising:

an organic light-emitting diode comprising an anode and a cathode;

a first transistor configured to provide a driving current directly from a high level voltage power source, the driving current flowing through the organic light emission diode;

a second transistor configured to provide data to a gate of the first transistor in response to a scan signal;

a capacitor configured to maintain a difference between a voltage level of the data and a threshold voltage of the first transistor; and a third transistor configured to:

sense a change of the threshold voltage of the first transistor in response to a sensing signal;

transfer a reference voltage from a reference power source to a node coupled to the anode when the sensing signal is enabled during a first time period, the organic light-emitting diode being configured to not emit light during the first time period;

block the reference voltage from reaching the node during a second time period subsequent to the first time period, the sensing signal being disabled during the second time period, the organic light-emitting diode being configured to emit light during the second time period; and transfer a compensation voltage from the capacitor to the reference power source during a third time period subsequent to the second time period, the organic light-emitting diode being configured to not emit light during the third time period, wherein a level of the reference voltage is lower than a threshold voltage of the organic light-emitting diode.

2. The pixel of claim 1, wherein a current flowing through the organic light-emitting diode is determined by the sensing signal.

3. The pixel of claim 2, wherein the organic light-emitting diode is controlled to be turned off based on the reference voltage when the sensing signal is enabled.

4. The pixel of claim 2, wherein, when the sensing signal is disabled:

the driving current flows from the first transistor through the organic light-emitting diode; and the organic light-emitting diode emits light.

5. The pixel of claim 3, wherein a time period when the sensing signal is enabled is adjustable.

6. A control method of a display device comprising a sensing transistor configured to perform a sensing operation, an organic light-emitting diode and a driving transistor configured to control a current for light emission of the organic light-emitting diode, the method comprising:

during a first time period:

transferring a reference voltage from a reference power source to a node coupled to the anode while the sensing signal is enabled; and the organic light-emitting diode does not emit light;

during a second time period subsequent to the first time period:

blocking the reference voltage from reaching the node;

disabling the sensing signal; and the organic light-emitting diode emitting light; and during a third time period subsequent to the second time period:

while controlling the organic light-emitting diode to be turned off while the sensing transistor is turned on, setting a reference voltage provided to the sensing transistor to have a lower level than a threshold voltage of the organic light-emitting diode;

enabling a sensing signal to turn on the sensing transistor; and applying the reference voltage to an anode of the organic light-emitting diode in response to the sensing signal, wherein the driving transistor provides a driving current directly from a high level voltage power source.

7. The method of claim 6, wherein:

the driving transistor is coupled to the organic light-emitting diode; and a current flows from the driving transistor to the sensing transistor when the sensing transistor is turned on.

8. The method of claim 6, wherein, when the reference voltage is applied to the anode of the organic light-emitting diode in response to the sensing signal, the organic light-emitting diode is turned off.

9. A display device, comprising:

a power source configured to provide:

a high level voltage;

a low level voltage; and a reference voltage, a panel configured to receive the high level voltage, the low level voltage, and the reference voltage from the power source, the panel comprising:

a plurality of pixels disposed at cross-points between data lines and scan lines, each of the pixels comprising an organic light-emitting diode;

the organic light-emitting diode comprising an anode and a cathode;

a first transistor configured to provide a driving current directly from the power source, the driving current flowing through the organic light-emitting diode;

a second transistor configured to provide data to a gate of the first transistor in response to a scan signal;

a capacitor configured to maintain a difference between a voltage level of the data and a threshold voltage of the first transistor; and a third transistor configured to:

sense a change of the threshold voltage of the first transistor in response to a sensing signal;

transfer the reference voltage from the power source to a node coupled to the anode when the sensing signal is enabled during a first time period, the organic light-emitting diode being configured to not emit light during the first time period;

block the reference voltage from reaching the node during a second time period subsequent to the first time period, the sensing signal being disabled during the second time period, the organic light-emitting diode being configured to emit light during the second time period; and transfer a compensation voltage from the capacitor to the reference power source during a third time period subsequent to the second time period, the organic light-emitting diode being configured to not emit light during the third time period, wherein a level of the reference voltage is lower than a threshold voltage of the organic light-emitting diode;

a scan driver configured to:

provide a scan signal to the scan lines; and provide a sensing signal for external compensation to the panel;

a data driver configured to provide a data to the data lines; and wherein the panel is further configured to control a time period of light emission of the organic light-emitting diode based on the sensing signal.

10. The display device of claim 9, wherein a current flowing through the organic light-emitting diode is determined by the sensing signal.

11. The display device of claim 10, wherein the organic light-emitting diode is controlled to be turned off based on the reference voltage when the sensing signal is enabled.

* * * * *